United States Patent [19]

Taylor

[11] Patent Number: 4,720,949

[45] Date of Patent: Jan. 26, 1988

[54] HYBRID SWIMMING POOL

[76] Inventor: Lawrence H. Taylor, P.O. Box 49-58, 48th Street Station, Union City, N.J. 07087

[21] Appl. No.: 9,097

[22] Filed: Jan. 29, 1987

Related U.S. Application Data

[63] Continuation of Ser. No. 788,644, Nov. 19, 1985, abandoned.

[51] Int. Cl.[4] ..... E04H 3/18

[52] U.S. Cl. ..... 52/169.7; 4/488

[58] Field of Search ..... 4/488; 52/169.7, 169.8, 52/245; D25/2

[56] References Cited

U.S. PATENT DOCUMENTS

| | | | |
|---|---|---|---|
| 3,020,560 | 2/1962 | Bedick | 52/169.7 |
| 3,031,801 | 5/1962 | Leuthesser | 52/169.7 |
| 3,443,263 | 5/1969 | Minasy | 52/245 |
| 3,522,614 | 8/1970 | Gould | 52/169.7 |
| 3,551,920 | 1/1971 | Greene | 52/169.8 |
| 3,735,427 | 5/1973 | Ancewicz et al. | 4/488 |
| 3,801,993 | 4/1974 | Stalder | 52/169.7 |
| 4,060,946 | 12/1977 | Lang et al. | 52/742 |

*Primary Examiner*—James L. Ridgill, Jr.

*Attorney, Agent, or Firm*—Kerkam, Stowell, Kondracki & Clarke

[57] ABSTRACT

This invention is directed to a novel hybrid type swimming pool for personal use which is well suited to the confined spaces of private yards and well adjusted to varying land contours, and the unique construction is specifically adapted to take advantage of semi in the ground placement of the pool so that the base or the lower portion of the pool where the hydrostatic pressure is the greatest is supported by the ground itself. The top of the pool is framed to provide strength against different pool stresses. Thus the novel construction technique for the first time permits low cost construction of an exercise pool, a facility needed by a large portion of the population at a price affordable to them.

3 Claims, 2 Drawing Figures

HYBRID SWIMMING POOL

This is a continuation of application Ser. No. 788,644, filed Nov. 19, 1985, now abandoned.

BACKGROUND OF THE INVENTION

Private swimming pools have become very popular particularly in the sunbelt areas of the United States. Conventional private swimming pools are of two general types. The first type is the round pool which is completely constructed above ground level and is usually disassembled during the colder seasons of the year. The second type of pool which is substantially more expensive than the first mentioned type is constructed entirely within the ground thus requiring extensive excavation, grading and leveling.

BRIEF SUMMARY OF THE INVENTION

The present invention is directed to a hybrid type of swimming pool using novel engineering design to attain its shape at low cost that is particularly suited for swimming laps which is partially within the ground and partially projecting above the ground level. The pool is of rectangular configuration with its width being substantially less than its length and having a total sufficient depth to permit shallow diving starts for the swimmer. Support for the side walls of the hybrid pool is in part derived from the inground portion of its depth and in part by vertically arranged stakes which penetrate the soil to a depth at least equal to the depth of the pool plus 10% and by a horizontally extending frame or deck attached to stakes at the top of the pool and having a width at least sufficient to provide seating space for persons, thus the top frame is positioned at approximately bench height above the ground level. Such a pool has the added safety advantage in that small children, pool guests or animals will not inadvertantly trip or fall into the pool, as the above ground projection acts as a safety barrier.

The invention may be defined as a hybrid swimming pool utilizing the best features of above ground and in the ground pools and with new features such as the framed bench top not found in either of todays two common pool types. The pool is sized and shaped particularly suited for swimming laps. The pool has a rectangular configuration in plan with its length being substantially larger than its width by, for example, at least a factor of 5 or 6. The pool has a portion of its depth below ground level and a portion projecting above ground level.

The term Hybred is used to describe this new type of pool because the bottom of the pool derives its strength from the inground base structure which is set just deep enought to gain important structural strength from the ground at low cost while avoiding those unnecessary excavation expenses known to be incurred by customary inground pool construction, yet the top frame system makes the above ground portion firm and practical. The use of one mechanical structure for the pool base and amother mechanical structure for the pool top makes the pool a novel engineering solution permits the much more desirable long swimming path pool without extensive side bracing without which the above ground pool must be limited to round or oval shapes that cables in tension can contain.

The portion above ground level has a height above the ground level in the order of about 15 to 20 inches and a flat top frame attached to and extending around the top of the pool. The top frame has sufficient width to at least provide seating space for people. The top frame acts as a rigidifying structure for the portion of the pool projecting above the ground.

BRIEF DESCRIPTION OF THE DRAWINGS

The invention will be more particularly described in reference to the accompanying drawing wherein.

DETAILED DESCRIPTION OF THE INVENTION

Figure 1:
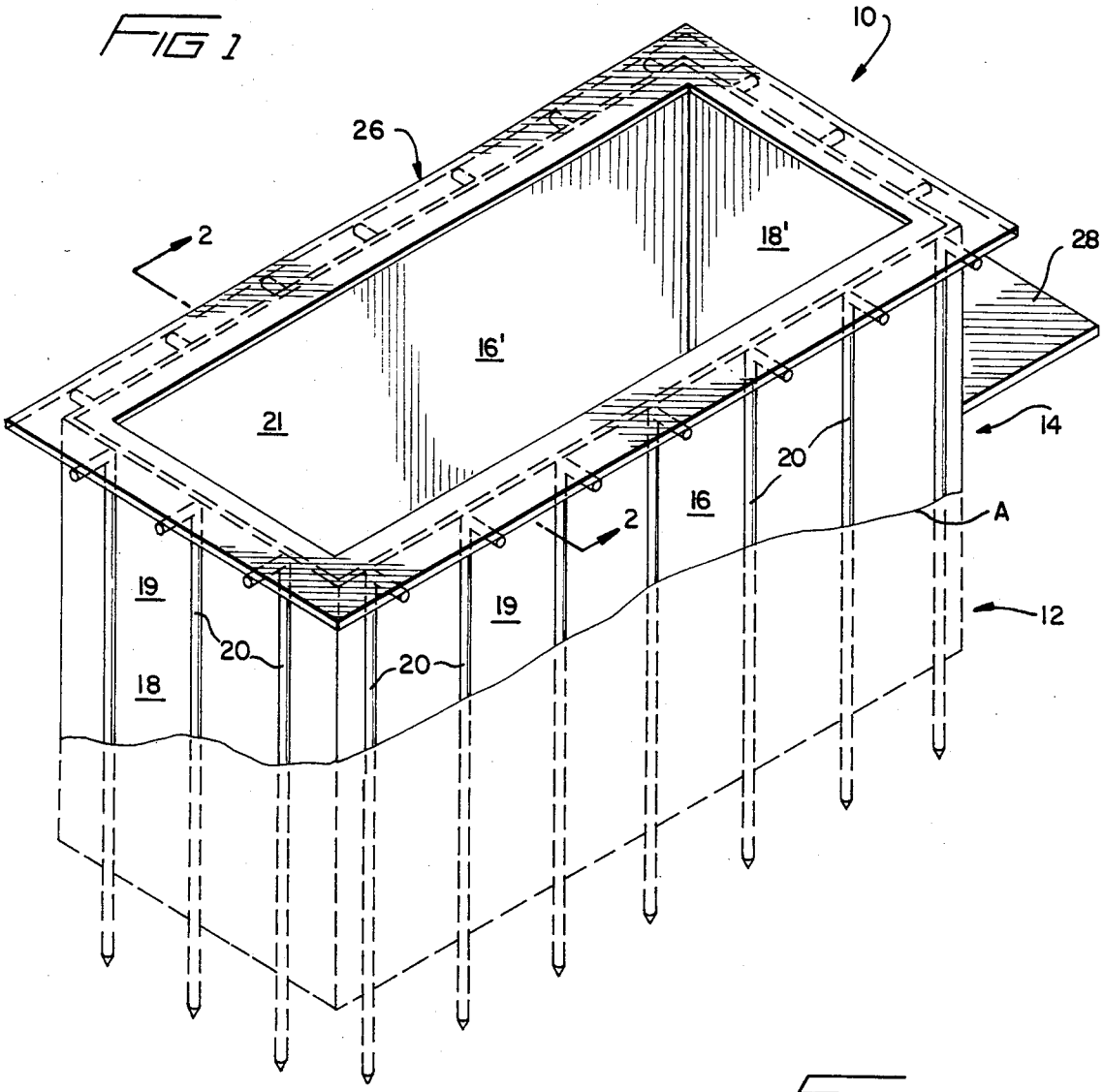
FIG. 1 is a perspective view of a pool constructed in accordance with the teachings of the present invention.

Referring to the drawing 10 generally designates a form of applicant's hybrid swimming pool having a portion 12 below ground level designated A and a portion 14 above the ground. The swimming pool 10 is rectangular in plan having long sides 16 and 16' and short sides or ends 18 and 18'. The sidewalls of the pool may be formed of sheet metal plates 19 affixed to the vertical stakes 20 and covered with plastic 21. The stakes 20 have right angle top portions 24.

The stakes 20 are driven into the ground preferably to a greater depth than the pool bottom 22. The plurality of stakes support the sidewalls 16, 16', 18 and 18' which project above the ground level A. The stakes as stated above may be provided with angle extensions 24 to assist in the support of the top frame generally designated 26. The top frame 26 is preferably formed of lumber and the frame has a width of about 15 to 18 inches and forms a very rigid construction for the above ground portion of the walls of the pool.

Figure 2:
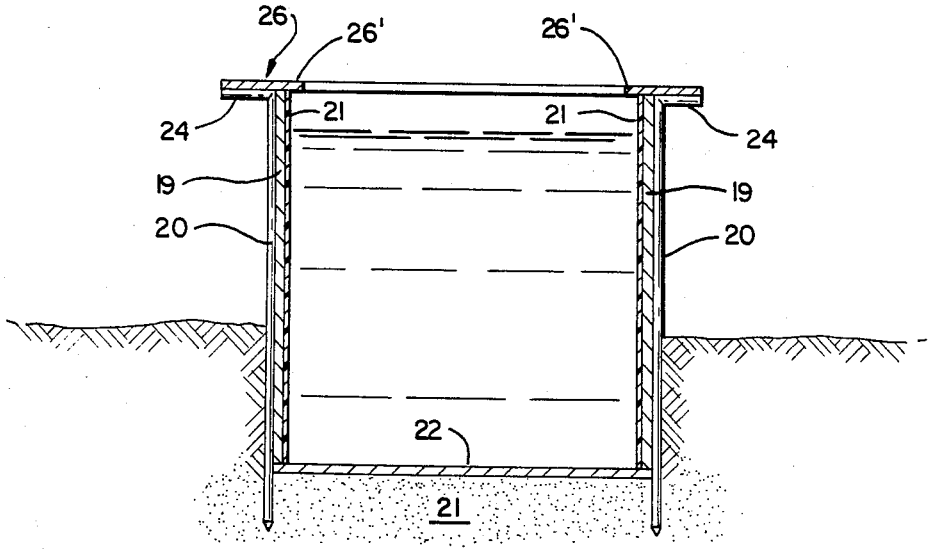
FIG. 2 is a section substantially on line 2—2 of FIG. 1.

As more clearly illustrated in FIG. 2 of the drawing the top frame projects both inwardly and outwardly of the pool. The inward projection 26' is substantially less than the outward projection, for example, if the top frame is 15 inches in width the inward projection would be about 3 inches. This inward projection assists in preventing water in the pool from splashing out of the pool during swimming and diving.

The top frame 26 is preferably about 15 to 18 inches above the ground level A, that is, at bench height to provide seating space for persons.

The pool enclosures composed of sides 16, 16' and 18 and 18' is provided with a sand bottom 21 to a depth of 6 inches and then receives a plastic pool liner which folded over the sides of the pool enclosure before the pool top frame is mounted.

As illustrated in FIG. 1, the ground level A need not be level so that the pool may be located on sloping land, along fence lines or wall lines or structures on the property at a minimal cost for excavation and land grading.

Where the slope of the land is so great that the top frame 26 is substantially above ground level at one end or side than, a second frame, ledge or shelf 28 as illustrated adjacent wall 18' may be provided. The second platform 28 provides additional seating space and acts as a step in reaching the top frame 16.

In a preferred embodiment of the present hybrid pool, the length of the sides 16 and 16' is substantially longer than the ends 18 and 18' by, for example, a factor of 5 or 6 or more. Thus, if the width of the pool were 6 feet the length would be 30 or 36 feet or more thereby providing an effective lap swimming pool.

I claim:

1. A swimming pool structure comprising sheet metal side walls, means for retaining and supporting said side walls in a rectangular configuration including, a rectangular frame parallel to the ground outlining the top edge of the pool, said rectangular frame positioned parallel to the ground and outlining the top edge of the pool several inches above the intended water level line, said rectangular frame supported by a multiplicity of rigid vertical side support members attached at their tops to said rectangular frame and projecting downwardly substantially for about one foot into the ground along the sides of a shallow excavation made to fit the planar dimension of the pool bottom so that the lower major portion of the pool lies below ground level with the upper remaining substantial part of the pool being located above the ground level, sheet metal attached to the inner surface of the side support members and extending from the rectangular top frame to the lowest level of the pool.

2. The hybrid swimming pool as defined in claim 1 wherein the pool is provided with a sand bottom.

3. The hybrid swimming pool as defined in claim 2 wherein the top frame projects both inwardly and outwardly of the pool side and the inward projection assists in keeping splash in the pool and off the top surface of the flat top frame.

* * * * *